US005738122A

United States Patent [19]

Armbruster et al.

[11] Patent Number: 5,738,122

[45] Date of Patent: Apr. 14, 1998

[54] STORAGE CANISTER FOR SHAVING ITEMS

[76] Inventors: Joseph M. Armbruster; Sue B. Armbruster, both of 2700 NE. 47 St., Lighthouse Point, Fla. 33064

[21] Appl. No.: 433,016

[22] Filed: May 3, 1995

[51] Int. Cl.[6] ..... A45D 27/16; A45D 27/18

[52] U.S. Cl. ..... 132/290; 132/289; 132/286; 132/314; 132/294; 206/581

[58] Field of Search ..... 132/286, 289, 132/290, 294, 297, 314; 220/572; 206/581, 349, 564, 208

[56] References Cited

U.S. PATENT DOCUMENTS

| | | | |
|---|---|---|---|
| D. 88,167 | 11/1932 | Nerein | 132/314 |
| 390,089 | 9/1888 | McClelland | 132/286 |
| 1,887,123 | 11/1932 | Flinterman | 132/289 |
| 1,887,124 | 11/1932 | Flinterman | 132/289 |
| 1,932,603 | 10/1933 | Richardson | 132/289 |
| 2,965,109 | 12/1960 | Borah | 132/289 |

*Primary Examiner*—Gene Mancene
*Assistant Examiner*—Pedro Philogene
*Attorney, Agent, or Firm*—Jacobson, Price, Holman & Stern, PLLC

[57] ABSTRACT

A storage canister for shaving items including a base having an upper surface with a plurality of recesses formed therein for receiving a plurality of shaving items and a vertically extending cover or enclosure removably mounted on the base for enclosing the shaving items when the cover or enclosure is in place on the base and providing easy access to the shaving items when the cover or enclosure is lifted off the base. The storage canister base includes a bottom surface which can be placed on any convenient supporting surface adjacent to or contiguous with a bathroom lavatory sink such as a countertop surface. The recesses in the base are shaped to receive shaving items such as the head of a razor, a razor blade cartridge dispenser and a container for a shaving lubricant in the form of gel or cream in which the container is in the form of a squeeze tube. The storage canister provides a functionally effective retainer and support for the shaving items to retain them in an easily accessible position and in a small concentrated area or space so that a minimum space on a countertop surface is occupied or consumed as compared to such items being randomly placed on a supporting surface or in a cabinet, drawer or the like. Also, the storage canister provides an attractive bathroom accessory due to a uniquely attractive shape and external surface appearance characteristics.

8 Claims, 3 Drawing Sheets

STORAGE CANISTER FOR SHAVING ITEMS

BACKGROUND OF THE INVENTION

1. Field of the Invention

This invention relates to a storage canister for shaving items including a base having an upper surface with a plurality of recesses formed therein for stably receiving and supporting a plurality of shaving items and a vertically extending cover or enclosure removably mounted on the base for enclosing the shaving items when the cover or enclosure is in place on the base and providing easy access to the shaving items when the cover or enclosure is lifted off the base. The storage canister base includes a bottom surface which can be placed on any convenient supporting surface adjacent to or contiguous with a bathroom lavatory sink such as a countertop surface. The recesses in the base are shaped to receive shaving items such as the head of a razor, a razor blade cartridge dispenser and a container for a shaving lubricant in the form of gel or cream in which the container is in the form of a squeeze tube. The storage canister provides a functionally effective retainer and support for the shaving items to retain them in an easily accessible position and in a small concentrated area or space so that a minimum space is consumed or occupied on a countertop or the like as compared to such items being randomly placed on a supporting surface or in a cabinet, drawer or the like. Also, the storage canister provides an attractive bathroom accessory due to a uniquely attractive shape and external surface appearance characteristics.

2. Description of the Prior Art

Shaving items, such as a razor, razor blade cartridge dispenser and shaving cream are frequently stored in a random fashion on a countertop supporting surface, on a shelf in a wall cabinet or in a drawer located in the bathroom. If the shaving items are merely placed on a countertop, they occupy or consume a large space, are unsightly, subject to becoming misplaced and possibly causing injury to users of the bathroom. When stored in a cabinet or drawer, shaving items frequently become entangled with other items and, in some instance, are difficult to locate. Various packaging has been provided for individual items such as packaging containers for razors which are primarily for the purpose of supporting the razor in an enclosed area provided with a transparent cover to enable observation of the razor in a retail establishment. Such containers usually include a structure to support a razor in a generally horizontal position when placed on a horizontal supporting surface such as on a shelf in a wall cabinet and may include a transverse and longitudinal recess receiving a portion of the razor head and handle. A typical shaving cream container with propellant is cylindrical with a 2⅝ O.D. and 6½ height. A typical razor blade cartridge dispenser is generally rectangular and of different lengths depending on the number of cartridges contained in the dispenser. These shaving items are stored in independent relation to each other and occupy a large space when placed on a countertop, on a cabinet shelf or in a drawer.

Conventional shaving item packaging, as described above, does not include a storage canister structure as incorporated into the present invention and which includes a base structure having a plurality of recesses receiving multiple shaving items in a vertical orientation combined with a removable cover concealing and protecting the shaving items. The base and cover are generally cylindrical and generally the same size as a typical shaving cream container thereby occupying or consuming minimum countertop space as compared with independent shaving items. The upper end of the cover is generally semispherical with the external surface of the storage canister incorporating uniquely attractive appearance characteristics.

SUMMARY OF THE INVENTION

An object of the present invention is to provide a storage canister for shaving items to support a plurality of shaving items in a vertical position on a supporting base with a removable cover enclosing the shaving items and telescopically engaging an upper portion of the supporting base to enable easy removal and replacement of the cover to provide access to the shaving items when desired and to conceal and protect the shaving items when the cover is in place thereby maintaining the shaving items in a minimum space and in a readily accessible position with the storage canister providing an attractive unit which can be supported on a horizontal supporting surface such as a countertop in a bathroom or the like.

Another object of the invention is to provide a storage canister for shaving items in which the base includes a plurality of vertically extending recesses or sockets shaped to receive and position a lower end portion of vertically disposed shaving items to enable the shaving items to be self supporting on the base in order for such items to consume minimum countertop space and to enable the cover to be easily assembled on the base and removed from the base while the shaving items remain supported in the recesses on the base.

A further object of the invention is to provide a storage canister for shaving items as set forth in the preceding objects in which the base is provided with a plurality of apertures in the recess receiving the razor head to enable drainage of any moisture that may be on the head when placed in the recess and enabling air circulation for evaporation of any residual moisture.

Still another object of the invention is to provide a storage canister for shaving items of generally cylindrical configuration as defined previously in which the base includes a cushioning material on the lower surface thereof to prevent marring of a supporting surface and a decorative metallic finish on the external surface with the cover including a semispherical upper end provided with a decorative button type attachment on the external surface with the components of the storage canister being constructed of metal, plastic or the like having a smooth, finished external surface.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
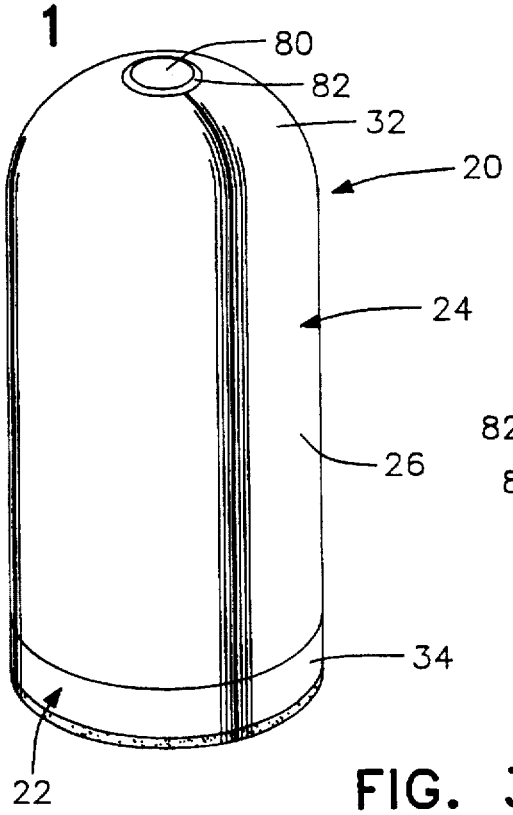
FIG. 1 is a perspective view of the storage canister for shaving items of the present invention.
Figure 2:
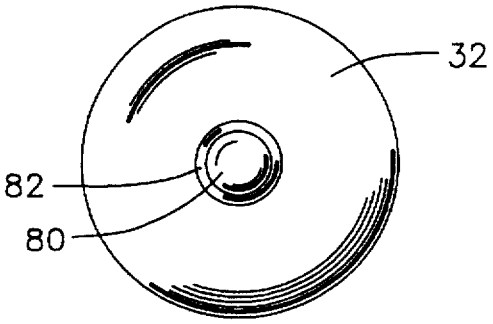
FIG. 2 is a top plan view of the storage canister.

The storage canister for shaving items of the present invention is generally designated by reference numeral 20 and includes a base 22 and a vertically extending removable cover or enclosure 24 with both components generally being of cylindrical configuration and extending vertically with the cover or enclosure 24 being defined by a relatively thin peripheral wall 26 defining a hollow interior 28 and including a bottom edge 30 oriented in a horizontal plane. The upper end of the cover or enclosure 24 is semispherical as indicated by reference numeral 32.

Figure 3:
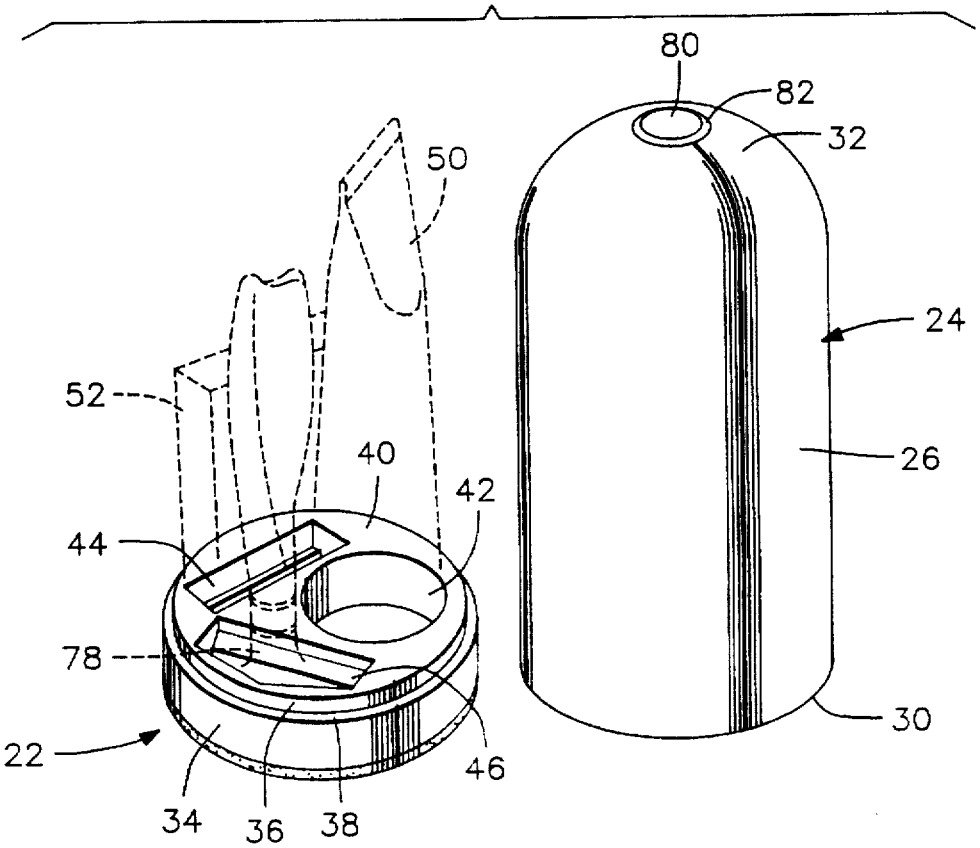
FIG. 3 is an exploded perspective view of the storage canister illustrating the cover separated from the base and illustrating the shaving items in broken lines.
Figure 4:
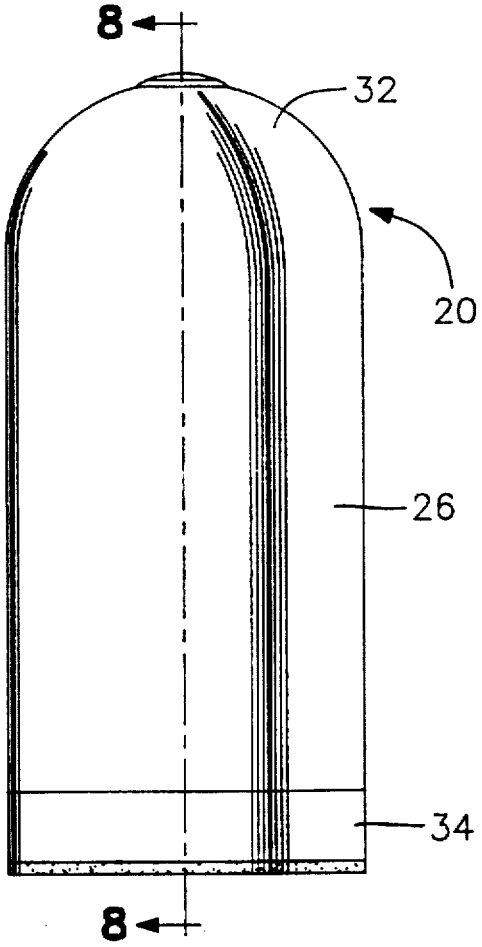
FIG. 4 is a side elevational view of the storage canister.
Figure 5:
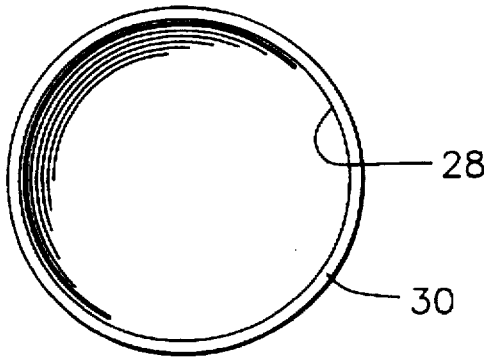
FIG. 5 is a bottom plan view of the storage canister cover.
Figure 6:
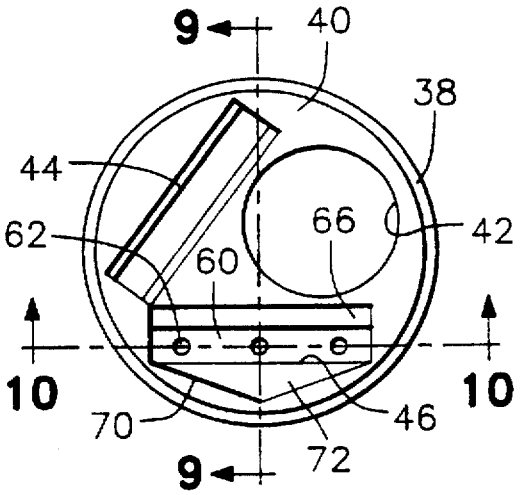
FIG. 6 is a top plan view of the base.
Figure 7:
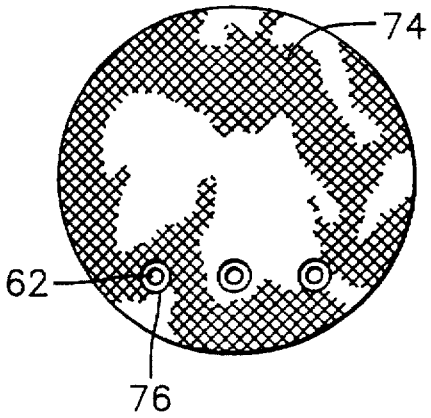
FIG. 7 is a bottom plan view of the base.

The base 22 includes a cylindrical peripheral wall 34 having an inwardly offset upper end portion 36 which defines a horizontal upwardly facing shoulder 38. A horizontally disposed upper end wall 40 is oriented at the upper end of the base. The upper end wall 40 includes a generally cylindrical recess 42 offset from the center of the base and a generally rectangular recess 44 extending generally tangentially to one surface area of the recess 2 and a generally rectangular recess 46 oriented generally tangentially to another surface of the cylindrical recess 42 as illustrated in FIGS. 3 and 6.

Figure 8:
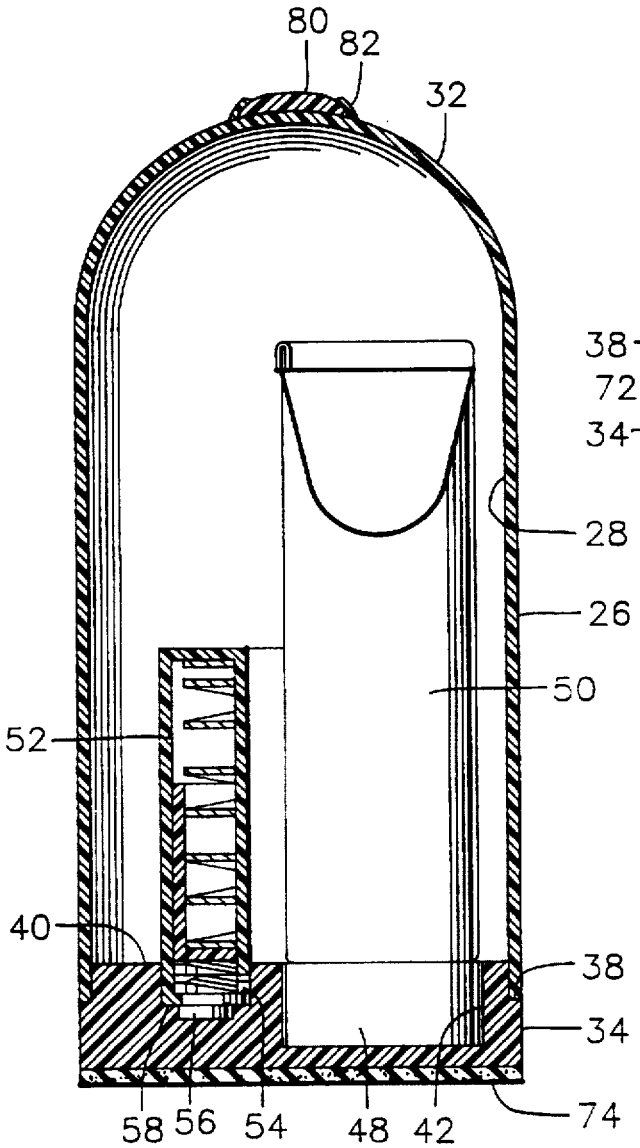
FIG. 8 is a vertical sectional view taken along section line 8—8 on FIG. 4 illustrating the structure of the storage canister in assembled relation with the position of the shaving items within the storage canister being illustrated.

The recess 42 has a depth greater than the recesses 44 and 46 and telescopically and closely receives a closure cap 48 of a squeeze tube 50 which extends vertically over a major portion of the vertical height of the cover 24 as illustrated in FIG. 8. The squeeze tube 50 receives a shaving lubricant such as a gel or cream or the like and the support of the squeeze tube and cap with the cap downwardly assures that when the squeeze tube and cap are removed from the base and the cap with attached plug, which seals the tube by entering the discharge orifice in the tube, is pivoted to open position, the gel or cream in the squeeze tube will be immediately available for use. The cap 48 on the inverted tube 50 is closely and telescopically received within the recess 42 thereby removably supporting the shaving lubricant vertically within the storage canister. The recess 42 is also capable of receiving a screw-on cap as well as the flip-type cap.

Figure 9:
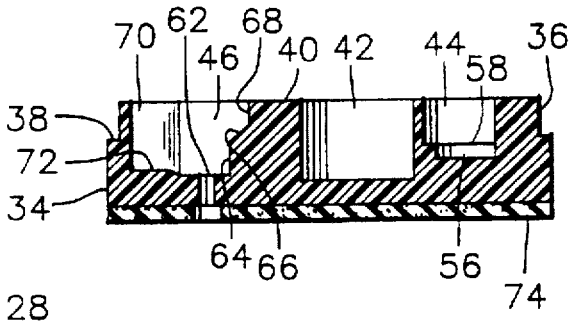
FIG. 9 is a transverse cross sectional view taken substantially upon a plane passing along section line 9—9 on FIG. 6 illustrating the recesses in the top surface of the base.
Figure 10:
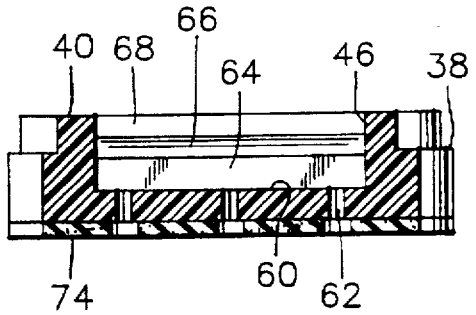
FIG. 10 is a sectional view taken substantially along section line 10—10 on FIG. 9 illustrating further structure of the razor head receiving recess including the apertures communicating with the lower surface of the recess.

The recess 44 closely and telescopically receives the lower end portion of a razor blade cartridge dispenser 52 which is of rectangular configuration and includes a structure 54 at one edge portion thereof to enable access to the razor blades in the cartridge dispenser. When the cartridge dispenser 52 is inserted into the recess 44, the access opening 54 is closed. Also, the recess 44 includes a central shallow recess 56 of less width than the major upper portion of the recess 44 thus defining longitudinal edge shoulders 58 which abuttingly engage and stabilize the razor blade cartridge dispenser 52 when it is positioned in the recess 44 thus stabilizing the razor blade cartridge dispenser 52 in a vertical position generally parallel to the peripheral wall 26 of the cover 24 and generally parallel to the squeeze tube 50. The lengthwise extent of the recess 44 is illustrated in FIG. 6 and the configuration thereof is illustrated in FIGS. 8 and 9. The cartridge dispenser 52 may be sized to store 5 or 10 razor blade cartridges by varying the height of the dispenser and constructed in a manner to receive used razor blade cartridges.

The recess 46 includes a generally horizontal bottom surface 60 provided with a plurality of apertures 62 extending therethrough. The inner wall of the recess 46 includes a vertical lower portion 64, an intermediate outwardly and upwardly inclined portion 66 and a vertical upper end portion 68 as illustrated in FIG. 9. The outer wall of the recess 46 includes a shallow V-shaped configuration as indicated by reference numeral 70 which extends toward the outer wall 34 as shown in FIG. 6 and to a vertical depth slightly less than the portion of the bottom wall 60 which has the apertures therein to define a shoulder 72 just slightly above the bottom wall 60 as illustrated in FIG. 9.

The bottom end surface of the base 22 is substantially planar and has a layer of cushioning material; such as felt or rubber material designated by reference numeral 74 adhesively secured to the bottom end of the base 24. The cushioning material 74 includes apertures 76 in alignment with and registry with the apertures 62 to provide for drainage of excess moisture and evaporation of moisture by circulation of air within the storage canister. Usually, the razor head 78 which fits into the recess 46 will have most of the excessive moisture removed by shaking the razor prior to insertion into the recess. The openings 62 and 76 enable the interior of the storage canister to be maintained in a substantially dry condition.

A decorative insert in the form of a button 80 of pearl or similar material generally is mounted on the upper end of the cover or enclosure 26. A gold ring 82 in the form of a lip formed on the storage canister cover retains the pearl insert in place as illustrated in FIG. 8. The pearl insert provides a decorative addition to the cover and will hide the sprue which occurs during the injection molding process when forming the cover or enclosure. The decorative insert may also be in the form of a trademark, logo or insignia relating to various products, corporations, educational institutions, sports teams, organizations and the like. Also, the storage canister base 22 may be of injection molded plastic or die cast zinc metal which can be plated in gold, chrome or silver with the ring 82 and the external surface of the cylindrical wall 34 having the same color characteristics.

The dimensional characteristics of the storage canister may vary. However, a height of 7 inches, an outside diameter of 3 3/16 inches and a flange 38 having a width of 1/8 inch has provided a structure with sufficient room for the shaving items and an attractive appearance. Thus, the storage canister 10 of this invention occupies virtually the same space as a typical shaving cream container. The three drain holes 62 are 1/8 inch in diameter, the thickness of the storage canister cover 24 is approximately 1/8 inch and the pad 74 is 1/8 inch thick and the outside diameter is slightly less than the outside diameter of the base.

The storage canister 20 can be provided with any desired distinctive external color or design ornamentation compatible with the decorative motif of the countertop or other bathroom surfaces on which the storage canister may be placed. The storage canister provides an attractive storage area which is small but sufficient to support the shaving items on a countertop without consuming a large surface area of the countertop. The storage canister also provides immediate access to the shaving items when desired and effectively retains all of the shaving items in a vertical, generally parallel relationship to each other and to the components of the storage canister and provides a bathroom accessory that has a unique appearance and functions effectively to support and conceal shaving items.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A storage canister for shaving items comprising a rigid base having a flat planar bottom surface for positioning on a generally horizontal support, said base including a flat upper surface provided with a plurality of vertically opening recesses for telescopically receiving and retaining a plurality of vertically oriented shaving items, and a removable cover mounted on said base, said cover being vertically disposed and sufficient in length to encompass said shaving items, said base including a plurality of drain openings extending between the bottom of one of said recesses and the bottom surface of the base to drain excessive moisture from a razor head positioned in said one of said recesses.

2. The storage canister as defined in claim 1 wherein said base and cover are cylindrical with the diameter of the storage canister being substantially less than the height, said cover including a generally semispherical upper end, an upwardly and inwardly inclined annular ring on the upper end of the cover, and a button retained on the upper end of the cover by said ring.

3. The storage canister as defined in claim 1 wherein said base includes a cushioning material on the bottom surface thereof to prevent marring a support surface, said cushioning material having openings therein aligned with the drain openings in said recess for drainage of and evaporation of moisture.

4. The storage canister as defined in claim 3 wherein one of said recesses is rectangular for telescopically receiving a lower edge portion of a razor blade cartridge dispenser, said recess having the drain openings therein being rectangular to receive a razor head of a razor oriented vertically in the canister.

5. A shaving item support comprising a heavy, rigid base having a peripheral wall, a flat rigid bottom surface and a generally horizontal top wall, said top wall including a plurality of recesses each defined by a horizontal bottom surface and upstanding peripheral surfaces oriented to closely receive and stably support a plurality of vertically disposed shaving items removably in said recesses, one of said recesses being cylindrical to telescopically receive the cylindrical cap of an inverted squeeze tube containing a shaving lubricant, two other recesses being of rectangular configuration receiving a razor blade dispenser and a razor head on a vertical razor, respectively, said recess receiving the razor head having a plurality of drain openings therein to drain excess moisture from the recess, a resilient cushioning material covering said bottom surface of the base to stably support the base on a support surface, said cushioning material having a plurality of drain openings in alignment with the drain openings in the recess receiving the razor head.

6. The shaving item support as defined in claim 5 wherein said recess receiving the razor head includes an inner longitudinal side wall having an outwardly and upwardly inclined intermediate portion, said recess receiving the razor head including a longitudinal side wall of shallow V-shaped configuration, said V-shaped wall including a height slightly less than the depth of the recess receiving the razor head to define an upwardly facing shoulder at the bottom end portion of the V-shaped wall of the recess receiving the razor head.

7. The shaving item support as defined in claim 6 wherein said recess receiving a razor blade cartridge dispenser includes a central shallow recess in a bottom surface thereof of less width than an upper portion of the recess to define longitudinal edge shoulders which face upwardly to abuttingly engage and stabilize the razor blade cartridge dispenser when positioned against said shoulder.

8. The shaving item support as defined in claim 7 together with a cover mounted on said base, said base and cover being cylindrical and of substantially the same diameter, said base including an upwardly facing external shoulder receiving and supporting the lower end of the cover, said cover including a generally semispherical upper end provided with an upwardly projecting annular ring at the center of the upper end, a generally circular button received in and retained in said ring with the button including arcuate lower and upper surface to conform with the portion of the spherical upper end of the cover enclosed by said ring and defining an arcuate upper surface exposed upwardly through said ring.

* * * * *